US009972257B2

(12) United States Patent
Yang et al.

(10) Patent No.: US 9,972,257 B2
(45) Date of Patent: May 15, 2018

(54) POLARITY INVERSION DRIVING METHOD AND APPARATUS FOR LIQUID CRYSTAL DISPLAY PANEL, AND LIQUID CRYSTAL DISPLAY

(71) Applicants: Boe Technology Group Co., Ltd., Beijing (CN); HEFEI BOE OPTOELECTRONICS TECHNOLOGY CO., LTD., Hefei, Anhui (CN)

(72) Inventors: Yuting Yang, Beijing (CN); Hengzhen Liang, Beijing (CN); Wenhao Zhang, Beijing (CN); Yang Zhang, Beijing (CN); Chun Ye, Beijing (CN)

(73) Assignees: BOE TECHOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 204 days.

(21) Appl. No.: 14/106,238

(22) Filed: Dec. 13, 2013

(65) Prior Publication Data

US 2014/0176411 A1 Jun. 26, 2014

(30) Foreign Application Priority Data

Dec. 14, 2012 (CN) ..... 2012 1 0546596

(51) Int. Cl.
*G09G 3/36* (2006.01)

(52) U.S. Cl.
CPC ..... *G09G 3/3614* (2013.01); *G09G 3/3688* (2013.01)

(58) Field of Classification Search
CPC .. G09G 3/3614; G09G 3/3275; G09G 3/3266; G09G 3/3696; G09G 2310/027
See application file for complete search history.

(56) References Cited

U.S. PATENT DOCUMENTS

2005/0168425 A1* 8/2005 Takada ..... G09G 3/2051 345/94
2007/0001965 A1 1/2007 Lee
(Continued)

FOREIGN PATENT DOCUMENTS

CN 101577091 A 11/2009

OTHER PUBLICATIONS

English translation of Office Action in corresponding Chinese Patent Application No. 2012105465966, dated May 5, 2014.
(Continued)

*Primary Examiner* — William Boddie
*Assistant Examiner* — Alecia D English
(74) *Attorney, Agent, or Firm* — Kinney & Lange, P.A.

(57) ABSTRACT

A polarity inversion driving method and apparatus for a liquid crystal display panel, and a liquid crystal display, is provided in order to solve the technical problem in the prior art that the interference strips are concentrated in one line, without increasing the power consumption of the liquid crystal display panel. The method comprises the steps of: generating N polarity control signals of different timings, wherein N is an integer and N≥2, and each polarity control signal is used to control a polarity voltage for sub-pixels in one or more columns of a liquid crystal display panel; and outputting the N polarity control signals to polarity control lines in the liquid crystal display panel, wherein each polarity control line corresponds to one polarity control signal.

6 Claims, 4 Drawing Sheets

(56) References Cited

U.S. PATENT DOCUMENTS

| | | | | |
|---|---|---|---|---|
| 2008/0252624 | A1* | 10/2008 | Jang | G09G 3/3648 345/204 |
| 2009/0179845 | A1* | 7/2009 | Song | G09G 3/3614 345/90 |
| 2009/0310077 | A1* | 12/2009 | Kim | G09G 3/3614 349/151 |
| 2011/0050553 | A1* | 3/2011 | Takada | G09G 3/3688 345/96 |
| 2011/0255020 | A1 | 10/2011 | Yu et al. | |
| 2012/0287170 | A1* | 11/2012 | Cheng | G09G 3/3614 345/690 |

OTHER PUBLICATIONS

Office Action dated Sep. 5, 2014, in parent Chinese Patent Application No. 2012105465966.
Office Action dated Dec. 29, 2014, in parent Chinese Patent Application No. 2012105465966.

* cited by examiner

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

Figure 3
(Prior Art)

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

Figure 4
(Prior Art)

| | | | | | | | |
|---|---|---|---|---|---|---|---|
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |

Figure 5
(Prior Art)

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| − | + | − | + | − | + | − | + |
| − | + | − | + | − | + | − | + |
| − | + | − | + | − | + | − | + |
| − | + | − | + | − | + | − | + |

Figure 6
(Prior Art)

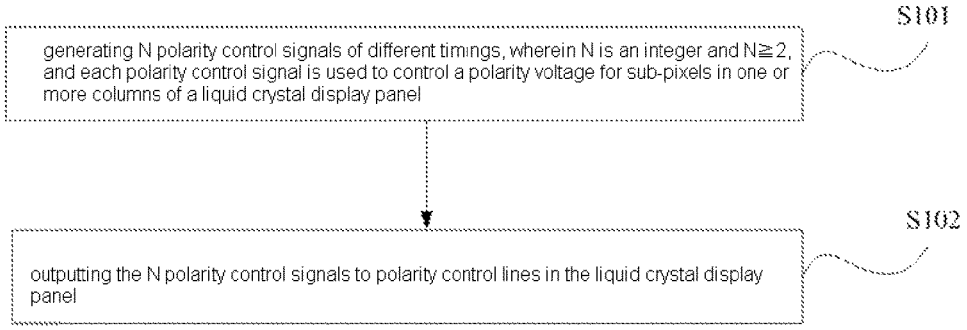
Figure 7
| | | | | | | | |
|---|---|---|---|---|---|---|---|
| + | − | + | − | + | − | + | − |
| − | + | + | − | − | + | + | − |
| − | + | − | + | − | + | − | + |
| + | − | − | + | + | − | − | + |
| + | − | + | − | + | − | + | − |
| − | + | + | − | − | + | + | − |
| − | + | − | + | − | + | − | + |
| + | − | − | + | + | − | − | + |
Figure 8
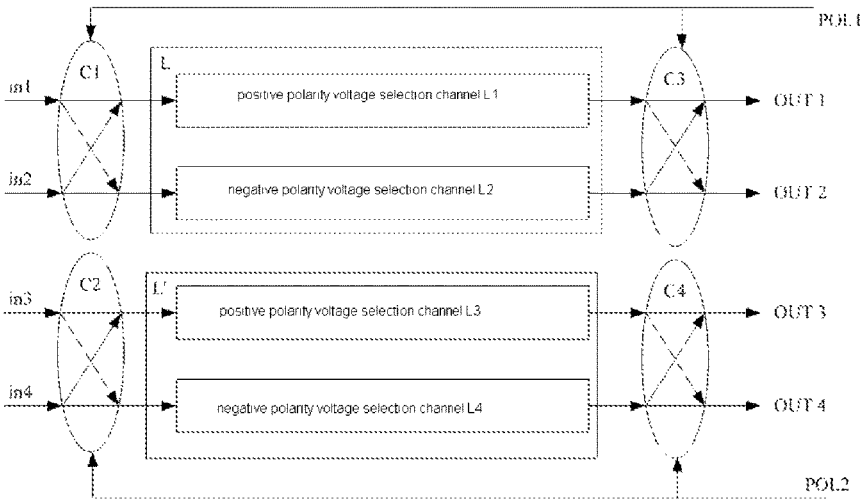
Figure 9

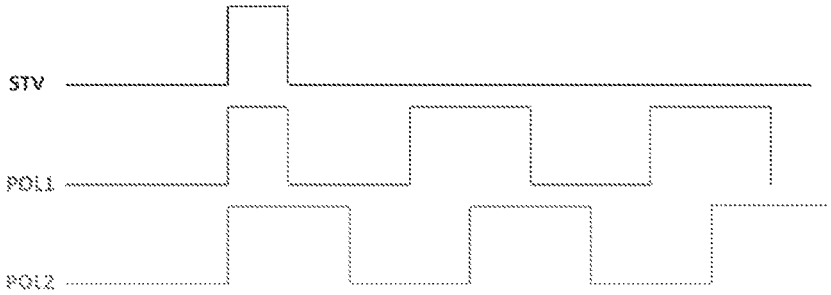
Figure 10
| | | | | | | | |
|---|---|---|---|---|---|---|---|
| + | + | − | − | + | + | − | − |
| − | + | + | − | − | + | + | − |
| − | − | + | + | − | − | + | + |
| + | − | − | + | + | − | − | + |
| + | + | − | − | + | + | − | − |
| − | + | + | − | − | + | + | − |
| − | − | + | + | − | − | + | + |
| + | − | − | + | + | − | − | + |
Figure 11
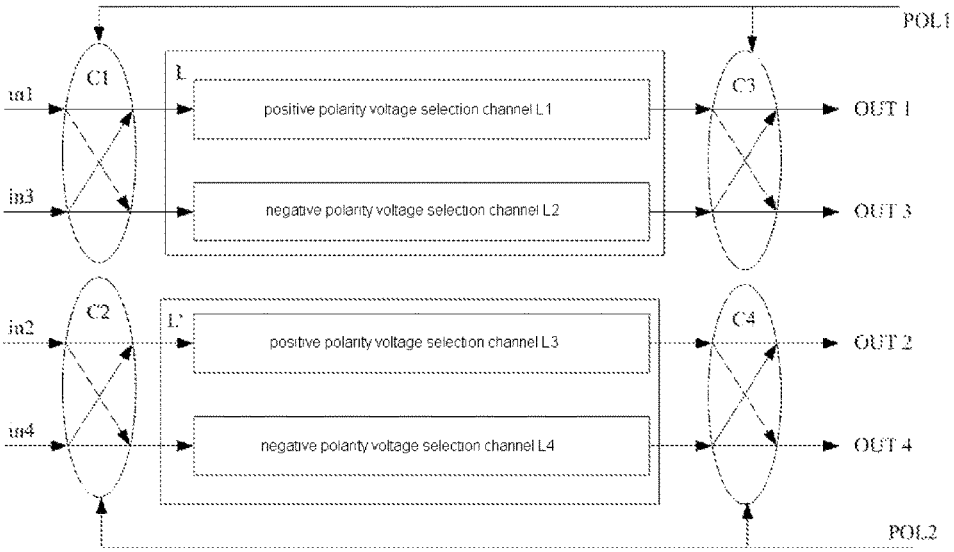
Figure 12

POLARITY INVERSION DRIVING METHOD AND APPARATUS FOR LIQUID CRYSTAL DISPLAY PANEL, AND LIQUID CRYSTAL DISPLAY

CROSS-REFERENCE TO RELATED APPLICATION

This application claims the benefit of Chinese Patent Application No. 201210546596.6 filed on Dec. 14, 2012 in the State Intellectual Property Office of China, the whole disclosure of which is incorporated herein by reference.

BACKGROUND OF THE INVENTION

Field of the Invention

The present invention relates to a technical field of display, and more particularly, to polarity inversion driving method and apparatus for a liquid crystal display panel, and a liquid crystal display (LCD).

Description of the Related Art

In an existing thin-film-transistor liquid crystal display (abbreviated as TFT-LCD), the manner for performing polarity inversion (changing from a positive polarity into a negative polarity or changing from a negative polarity into a positive polarity) is shown in FIG. 1. As shown in FIG. 1, the solution in the prior art includes a polarity control signal POL, a cache module B, a first channel selection module C1, a voltage selection channel L and a second channel section module C2, wherein the voltage selection channel L includes a positive-polarity-voltage selection channel L1 and a negative-polarity-voltage selection channel L2, and a signal, which is output from the positive-polarity-voltage selection channel, provides a corresponding positive polarity voltage, and a signal, which is output from the negative-polarity-voltage selection channel, provides a corresponding negative polarity voltage.

The cache module B receives from outside a first grayscale signal D1 and a second grayscale signal D2, and outputs them respectively to the first channel selection module C1 where the driving capacity of the first and second grayscale signals is enhanced. A first input port 3 and a second input port 4 of the first channel selection module C1 respectively receive the first grayscale signal and the second grayscale signal from a first output port 1 and a second output port 2 of the cache module B. Corresponding voltage selection channels are selected by the first channel selection module C1 for the first and second grayscale signals according to the polarity control signal, and the selection manner is shown in FIGS. 2A and 2B.

Referring to FIG. 2A, when the polarity control signal is at a high level, the first grayscale signal is input into the positive-polarity-voltage selection channel L1 via the first channel section module C1 and then provides a positive polarity voltage corresponding to the first grayscale signal to a first output port OUT1 via the second channel selection module C2; and the second grayscale signal is input into the negative polarity voltage section channel L2 via the first channel section module C1 and then provides a negative polarity voltage corresponding to the second grayscale signal to a second output port OUT2 via the second channel selection module C2.

Referring to FIG. 2B, when the polarity control signal is at a low level, the first grayscale signal is input into the negative-polarity-voltage selection channel L2 via the first channel section module C1 and then provides a negative polarity voltage corresponding to the first grayscale signal to the first output port OUT1 via the second channel selection module C2; and the second grayscale signal is input into the positive polarity voltage section channel L1 and then provides a positive polarity voltage corresponding to the second grayscale signal to the second output port OUT2 via the second channel selection module C2.

The first output port OUT1 is connected with pixel electrodes of sub-pixels in an odd-number column, and the polarity voltage corresponding to the first grayscale signal and output by the first output port is the voltage of the pixel electrode of the sub-pixels in the odd-number column, and the second output port OUT2 is connected with pixel electrodes of sub-pixels in an even-number column, and the polarity voltage corresponding to the second grayscale signal and output by the second output port is the voltage of the pixel electrode of the sub-pixels in the even-number column.

In existing solutions, based on different polarity control signals, a 1-dot polarity inversion mode, a 2-dot polarity inversion mode, a 1-dot+2-dot polarity inversion mode, and a 4-dot polarity inversion mode and the like may be achieved.

In the above modes, the 1-dot polarity inversion mode has the best display effect, and its polarity inversion manner is shown in FIG. 3. As shown in FIG. 3, an interference strip (noise) is invisible in the 1-dot polarity inversion mode, and the invisibility is resulted from close spacing between polarity inversion positions, specifically, since the polarity inversion in each line will affect data signals, the comprehensive effect is not obvious or there is cancelling out of one another. However, the power consumption of the display in the 1-dot polarity inversion mode is relatively high, thus the 1-dot+2-dot polarity inversion mode or the 2-dot polarity inversion mode is applied in most of the products, which may reduce power consumption while having little effect on the display effect.

In the TFT-LCD panel, it is very difficult to ensure complete uniformity of TFT characteristics. When the 1-dot+2-dot polarity inversion mode or the 2-dot polarity inversion mode is applied, there is some difference in charging rate between the TFTs in the polarity inversion line and the TFT in the subsequent line of the same polarity. If the difference reaches a certain level, a grayscale difference occurs, thus equally spaced strips (interference strips) will be observed, and the interference strips are concentrated in one certain line.

Further, in a data-line driving polarity inversion mode in a low frequency, if there is relative movement (in the upper and lower viewing angle range) between the observer and the display panel, the interference strips are easier to be observed, and a strip interval is the same as a polarity inversion interval. For example, in the 2-dot polarity inversion mode shown in FIG. 4, the next line below the black line is the location where the interference strip appears. It can be seen from FIG. 4 that if a 2-dot polarity inversion mode is used, the strip interval is of a two-dot width. FIG. 5 is a schematic view showing a 1-dot+2-dot polarity inversion mode, and it can be seen therefrom that the strip interval is of a two-dot width. FIG. 6 is a schematic view showing a 4-dot polarity inversion mode, and it can be seen from FIG. 6 that the strip interval is of a four-dot width.

SUMMARY OF THE INVENTION

A polarity inversion driving method and apparatus for a liquid crystal display panel, and a liquid crystal display, is provided in order to solve the technical problem in the prior art that the interference strips are concentrated in one line, and alternatively, without increasing the power consumption of the liquid crystal display panel.

An exemplary embodiment of the present invention provides a polarity inversion driving method for a liquid crystal display panel, the method comprising the steps of:

generating N polarity control signals of different timings, wherein N is an integer and N≥2, and each polarity control signal is used to control a polarity voltage for sub-pixels in one or more columns of a liquid crystal display panel; and outputting the N polarity control signals to polarity control lines in the liquid crystal display panel, wherein each polarity control line corresponds to one polarity control signal.

Another exemplary embodiment of the present invention provides a polarity inversion driving apparatus for a liquid crystal display panel, the apparatus comprising:

a polarity control signal generating unit for generating N polarity control signals of different timings, wherein N is an integer and N≥2, and each polarity control signal is used to control a polarity voltage for sub-pixels in one or more columns of a liquid crystal display panel; and a polarity control signal outputting unit for outputting the N polarity control signals to polarity control lines in the liquid crystal display panel, wherein each polarity control line corresponds to one polarity control signal.

A further exemplary embodiment of the present invention provides a liquid crystal display, comprising the above polarity inversion driving apparatus.

BRIEF DESCRIPTION OF THE DRAWINGS

The above and other features of the present invention will become more apparent by describing in detail exemplary embodiments thereof with reference to the accompanying drawings, in which:

FIG. 3 is a schematic view showing a 1-dot polarity inversion mode;

FIG. 4 is a schematic view showing a 2-dot polarity inversion mode;

FIG. 5 is a schematic view showing a 1-dot+2-dot polarity inversion mode;

FIG. 6 is a schematic view showing a 4-dot polarity inversion mode;

FIG. 7 is a schematic flow chart showing a polarity inversion driving method for a liquid crystal display panel according to an exemplary embodiment of the present invention;

FIG. 8 is a schematic view showing a inversion mode according to a first embodiment of the present invention;

FIG. 9 is a schematic view showing the achieving of the inversion mode provided in the first embodiment of the present invention;

FIG. 10 is a schematic view showing the polarity control signal timing;

FIG. 11 is a schematic view showing a inversion mode according to a second embodiment of the present invention; and FIG. 12 is a schematic view showing the achieving of the inversion mode provided in the second embodiment of the present invention.

DETAILED DESCRIPTION OF PREFERRED EMBODIMENTS OF THE INVENTION

Figure 1:
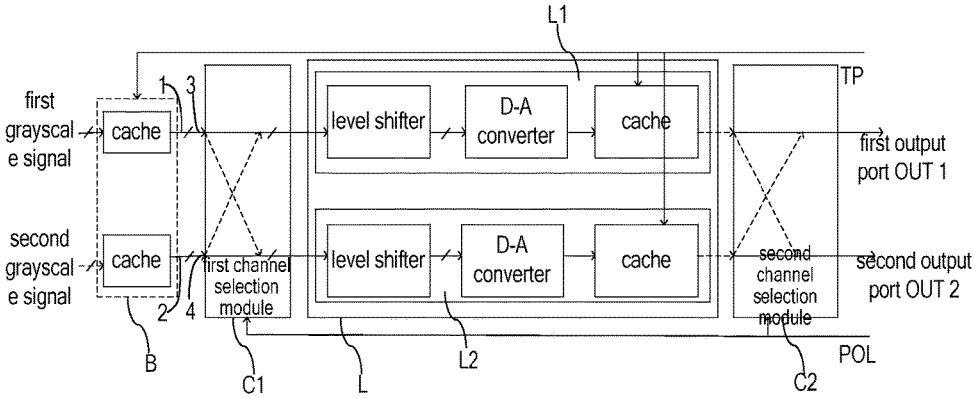
Figure 1 (Prior Art)
FIG. 1 is a schematic view showing the achieving of a polarity inversion in the prior art.
Figure 2A:
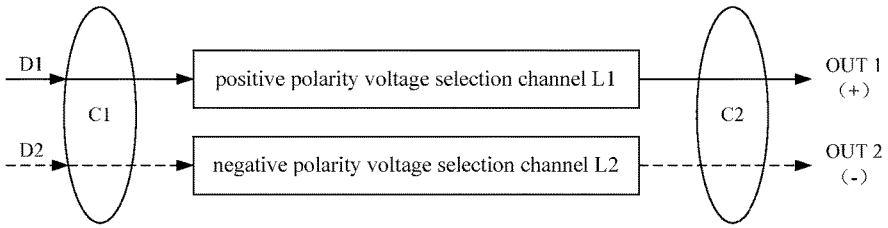
Figure 2A (Prior Art)
FIGS. 2A and 2B are schematic views, respectively, showing the achieving of a positive polarity voltage and a negative polarity voltage in the prior art.
Figure 2B:
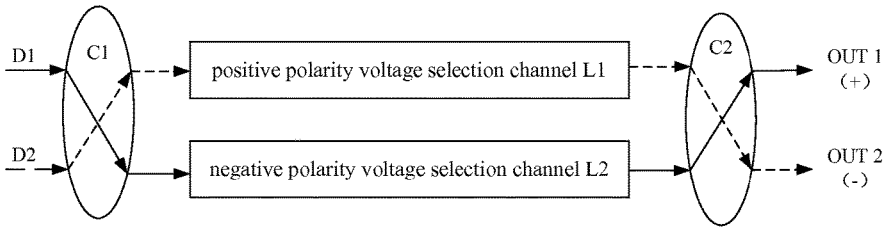
Figure 2B (Prior Art)

Exemplary embodiments of the present invention will be described hereinafter in detail with reference to the attached drawings, wherein the like reference numerals refer to the like elements. The present invention may, however, be embodied in many different forms and should not be construed as being limited to the embodiment set forth herein; rather, these embodiments are provided so that the present invention will be thorough and complete, and will fully convey the concept of the disclosure to those skilled in the art.

A polarity inversion driving method and apparatus for a liquid crystal display panel, and a liquid crystal display, is provided in order to solve the technical problem in the prior art that the interference strips are concentrated in one line, without increasing the power consumption of the liquid crystal display panel.

Referring to FIG. 7, a polarity inversion driving method for a liquid crystal display panel is provided, the method comprising the steps of:

S101: generating N polarity control signals of different timings, wherein N is an integer and N≥2, and each polarity control signal is used to control a polarity voltage for sub-pixels in one or more columns of a liquid crystal display panel; and

S102: outputting the N polarity control signals to polarity control lines in the liquid crystal display panel, wherein each polarity control line corresponds to one polarity control signal.

Alternatively, the N polarity control signals of different timings comprise a first polarity control signal and a second polarity control signal. In addition, the N polarity control signals of different timings may further comprise more polarity control signals having different timings, for example, a third polarity control signal and a fourth polarity control signal.

Alternatively, the first polarity control signal is used to control the polarity voltage of the sub-pixels in the $(4n+1)^{th}$ column and the $(4n+2)^{th}$ column of the liquid crystal display panel, and the second polarity control signal is used to control the polarity voltage of the sub-pixels in the $(4n+3)^{th}$ column and the $(4n+4)^{th}$ column of the liquid crystal display panel, wherein n is 0 or a natural number.

When the first polarity control signal POL1 is at a high level, the sub-pixels of the $(4n+1)^{th}$ column and the $(4n+2)^{th}$ column are supplied with the polarity voltage corresponding to a voltage signal which is output from a first positive-polarity-voltage selection channel (itself channel); and when the first polarity control signal POL1 is at a low level, the sub-pixels of the $(4n+1)^{th}$ column and the $(4n+2)^{th}$ column are supplied with the polarity voltage corresponding to a voltage signal which is output from a first negative-polarity-voltage selection channel (switching channel). When the second polarity control signal POL2 is at a high level, the sub-pixels of the $(4n+3)^{th}$ column and the $(4n+4)^{th}$ column are supplied with the polarity voltage corresponding to a voltage signal which is output from a second positive-polarity-voltage selection channel (itself channel); and when the second polarity control signal POL2 is at a low level, the sub-pixels of the $(4n+3)^{th}$ column and the $(4n+4)^{th}$ column are supplied with the polarity voltage corresponding to a voltage signal which is output from a second negative-polarity-voltage selection channel (switching channel).

Alternatively, the first polarity control signal is used to control the polarity voltage of the sub-pixels in an odd-number column of the liquid crystal display panel, and the second polarity control signal is used to control the polarity voltage of the sub-pixels in an even-number column of the liquid crystal display panel.

When the first polarity control signal POL1 is at a high level, the sub-pixels of the $(4n+1)^{th}$ column and the $(4n+3)^{th}$ column are supplied with the polarity voltage corresponding to a voltage signal which is output from a first positive-polarity-voltage selection channel (itself channel), and when the first polarity control signal POL1 is at a low level, the sub-pixels of the $(4n+1)^{th}$ column and the $(4n+3)^{th}$ column are supplied with the polarity voltage corresponding to a voltage signal which is output from a first negative-polarity-voltage selection channel (switching channel). When the second polarity control signal POL2 is at a high level, the sub-pixels of the $(4n+2)^{th}$ column and the $(4n+4)^{th}$ column are supplied with the polarity voltage corresponding to a voltage signal which is output from a second positive-polarity-voltage selection channel (itself channel), and when the second polarity control signal is at a low level, the sub-pixels of the $(4n+2)^{th}$ column and the $(4n+4)^{th}$ column are supplied with the polarity voltage corresponding to a voltage signal which is output from a second negative-polarity-voltage selection channel (switching channel).

The method may further comprise the step of dividing a sub-pixel matrix in the liquid crystal display panel into a plurality of regions in advance, and the step of "outputting the N polarity control signals to polarity control lines in the liquid crystal display panel" includes outputting respectively the polarity control signals of different timings to different regions of the sub-pixel matrix via the polarity control lines.

That is, the sub-pixel matrix in the liquid crystal display panel is divided into a plurality of small regions, wherein in one or more regions of the plurality of regions, the first polarity control signal is used to control the polarity voltage of the sub-pixels in the $(4n+1)^{th}$ column and the $(4n+2)^{th}$ column of the liquid crystal display panel, and the second polarity control signal is used to control the polarity voltage of the sub-pixels in the $(4n+3)^{th}$ column and the $(4n+4)^{th}$ column of the liquid crystal display panel, wherein n is 0 or a natural number; and in other regions of the plurality of regions of the sub-pixel matrix, the first polarity control signal is used to control the polarity voltage of the sub-pixels in an odd-number column of the liquid crystal display panel, and the second polarity control signal is used to control the polarity voltage of the sub-pixels in an even-number column of the liquid crystal display panel.

Or, in addition to the first and second polarity control signals, the N polarity control signals of different timings may further include more polarity control signals, for example, a third polarity control signal and a fourth polarity control signal having different timings. The third and fourth polarity control signals may control the polarity voltages of the sub-pixels in different columns in certain regions of the liquid crystal display panel by using a control manner the same as or different from that of the first and second polarity control signals.

A first embodiment of the present invention provides a polarity inversion driving method for a liquid crystal display panel, and the inversion manner thereof is shown in FIG. 8. As can be seen from FIG. 8, a stagger combining of the 1-dot+2-dot polarity inversion mode and the 2-dot polarity inversion mode is achieved in the first embodiment, that is, the 1-dot+2-dot polarity inversion mode and the 2-dot polarity inversion mode are used to be staggered in different columns so as to scatter the polarity inversion positions, so that the effect on data signals imposed by the polarity inversion is not concentrated in one line, and thus the purpose of making the interference strips not be concentrated in a line is achieved.

The manner for implementing the polarity inversion is achieved in FIG. 9. As shown in FIG. 9, the implementing includes: a first polarity control signal POL1, a second polarity control signal POL2, a first channel selection module C1, a second channel selection module C2, a third channel selection module C3, a fourth channel selection module C4, a first voltage selection channel L, a second voltage selection channel L', a first output port OUT1, a second output port OUT2, a third output port OUT3, and a fourth output port OUT4.

Alternatively, the timings of the first polarity control signal POL1 and the second polarity control signal POL2 are shown in FIG. 10. It can be seen from FIG. 10 that POL1 and POL2 are two polarity control signals having different timings, wherein the first polarity control signal POL1 is used to control the first channel selection module C1 and the third channel selection module C3, and the second polarity control signal POL2 is used to control the second channel selection module C2 and the fourth channel selection module C4. It should be noted that the first and second polarity control signals POL1 and POL2 are not limited to the polarity control signals having different timings shown in FIG. 10, and may be other polarity control signals having different timings.

The N polarity control signals may further comprise a third polarity control signal and a fourth polarity control signal having different timings. The third and fourth polarity control signals may control the polarity voltages of the sub-pixels in different columns in certain regions of the liquid crystal display panel by using a control manner the same as or different from that of the first and second polarity control signals.

The first voltage selection channel L includes a positive-polarity-voltage selection channel L1 and a negative-polarity-voltage selection channel L2, and the second voltage selection channel L' includes a positive-polarity-voltage selection channel L3 and a negative-polarity-voltage selection channel L4. The first channel selection module C1 includes a first input port in1 and a second input port in2, and the second channel selection module C2 includes a third input port in3 and a fourth input port in4. The third channel selection module C3 includes a first output port OUT1 and a second output port OUT2, and the fourth channel selection module C4 includes a third output port OUT3 and a fourth output port OUT4. The first and second input ports in1 and in2 of the first channel selection module C1 respectively receive a first grayscale signal and a second grayscale signal, and the third and fourth input ports in3 and in4 of the second channel selection module C2 respectively receive a third grayscale signal and a fourth grayscale signal.

In the embodiment of the present invention, when the first grayscale signal is required to obtain a corresponding positive polarity voltage, it may be directly input into the positive-polarity-voltage selection channel L1 of the first voltage selection channel L, and then the obtained positive polarity voltage is output to the first output port OUT1, without using the selection function of the first and second channel selection modules C1 and C2. Therefore, the positive-polarity-voltage selection channel L1 of the first voltage selection channel L is called as an itself channel of the first grayscale signal. While when the first grayscale signal is required to obtain a corresponding negative polarity voltage, the first grayscale signal is first input into the first channel selection module C1 and then input into the negative-polarity-voltage selection channel L2 of the first voltage selection channel L, and after obtaining a negative polarity voltage corresponding to the first grayscale signal, the negative polarity voltage is input to the first output port OUT1 via the third channel selection module C3. Therefore, the negative-polarity-voltage selection channel L2 of the first voltage selection channel L is called as a switching channel of the first grayscale signal. Similarly, the negative-polarity-voltage selection channel L2 of the first voltage selection channel L is called as an itself channel of the second grayscale signal, and the positive-polarity-voltage selection channel L1 of the first voltage selection channel L is called as a switching channel of the second grayscale signal; the positive-polarity-voltage selection channel L3 of the second voltage selection channel L' is called as an itself channel of the third grayscale signal; the negative-polarity-voltage selection channel L4 of the second voltage selection channel L' is called as a switching channel of the third grayscale signal; and the negative-polarity-voltage selection channel L4 of the second voltage selection channel L' is called as an itself channel of the fourth grayscale signal, and the positive-polarity-voltage selection channel L3 of the second voltage selection channel L' is called as a switching channel of the fourth grayscale signal.

The first output port OUT1 is connected with the pixel electrode of the sub-pixels in the $(4n+1)^{th}$ column, and the polarity voltage corresponding to the first grayscale signal and output from the first output port OUT1 is the voltage of the pixel electrode of the sub-pixels in the $(4n+1)^{th}$ column. The second output port OUT2 is connected with the pixel electrode of the sub-pixels in the $(4n+2)^{th}$ column, and the polarity voltage corresponding to the second grayscale signal and output from the second output port OUT2 is the voltage of the pixel electrode of the sub-pixels in the $(4n+2)^{th}$ column. The third output port OUT3 is connected with the pixel electrode of the sub-pixels in the $(4n+3)^{th}$ column, and the polarity voltage corresponding to the third grayscale signal and output from the third output port OUT3 is the voltage of the pixel electrode of the sub-pixels in the $(4n+3)^{th}$ column. The fourth output port OUT4 is connected with the pixel electrode of the sub-pixels in the $(4n+4)^{th}$ column, and the polarity voltage corresponding to the fourth grayscale signal and output from the fourth output port OUT4 is the voltage of the pixel electrode of the sub-pixels in the $(4n+4)^{th}$ column.

When the first polarity control signal POL1 is at a high level, the first grayscale signal is input into the positive-polarity-voltage selection channel L1 via the first channel section module C1 and then provides a positive polarity voltage corresponding to the first grayscale signal to the first output port OUT1 via the third channel selection module C3; and the second grayscale signal is input into the negative polarity voltage section channel L2 via the first channel section module C1 and then provides a negative polarity voltage corresponding to the second grayscale signal to the second output port OUT2 via the third channel selection module C3, and at this time, the voltage of the pixel electrodes of the $(4n+1)^{th}$ column is the positive polarity voltage corresponding to the first grayscale signal, and the voltage of the pixel electrodes of the $(4n+2)^{th}$ column is the negative polarity voltage corresponding to the second grayscale signal.

When the first polarity control signal POL1 is at a low level, the first grayscale signal is input into the negative-polarity-voltage selection channel L2 via the first channel section module C1 and then provides a negative polarity voltage corresponding to the first grayscale signal to the first output port OUT1 via the third channel selection module C3; and the second grayscale signal is input into the positive polarity voltage section channel L1 via the first channel section module C1 and then provides a positive polarity voltage corresponding to the second grayscale signal to the second output port OUT2 via the third channel selection module C3, and at this time, the voltage of the pixel electrodes of the $(4n+1)^{th}$ column is the negative polarity voltage corresponding to the first grayscale signal, and the voltage of the pixel electrodes of the $(4n+2)^{th}$ column is the positive polarity voltage corresponding to the second grayscale signal.

When the second polarity control signal POL2 is at a high level, the third grayscale signal is input into the positive-polarity-voltage selection channel L3 via the second channel section module C2 and then provides a positive polarity voltage corresponding to the third grayscale signal to the third output port OUT3 via the fourth channel selection module C4; and the fourth grayscale signal is input into the negative polarity voltage section channel L4 via the second channel section module C2 and then provides a negative polarity voltage corresponding to the fourth grayscale signal to the fourth output port OUT4 via the fourth channel selection module C4, and at this time, the voltage of the pixel electrodes of the $(4n+3)^{th}$ column is the positive polarity voltage corresponding to the third grayscale signal, and the voltage of the pixel electrodes of the $(4n+4)^{th}$ column is the negative polarity voltage corresponding to the fourth grayscale signal.

When the second polarity control signal POL2 is at a low level, the third grayscale signal is input into the negative-polarity-voltage selection channel L4 via the second channel section module C2 and then provides a negative polarity voltage corresponding to the third grayscale signal to the third output port OUT3 via the fourth channel selection module C4; and the fourth grayscale signal is input into the positive polarity voltage section channel L3 via the second channel section module C2 and then provides a positive polarity voltage corresponding to the fourth grayscale signal to the fourth output port OUT4 via the fourth channel selection module C4, and at this time, the voltage of the pixel electrodes of the $(4n+3)^{th}$ column is the negative polarity voltage corresponding to the third grayscale signal, and the voltage of the pixel electrodes of the $(4n+4)^{th}$ column is the positive polarity voltage corresponding to the fourth grayscale signal.

A second embodiment of the present invention provides another polarity inversion driving method for a liquid crystal display panel, and the inversion manner thereof is shown in FIG. 11. As can be seen from FIG. 11, the polarity inversion positions of any two adjacent sub-pixel columns are different from each other. A stagger combining of the 1-dot+2-dot polarity inversion mode and the 2-dot polarity inversion mode is achieved in the second embodiment, that is, the 1-dot+2-dot polarity inversion mode and the 2-dot polarity inversion mode are used to be staggered in different columns so as to scatter the polarity inversion positions, so that the effect on data signals imposed by the polarity inversion is not concentrated in one line, and thus the purpose of making the interference strips not be concentrated in a line is achieved.

The manner for implementing the polarity inversion manner of the second embodiment of the present invention is achieved in FIG. 12. As shown in FIG. 12, the implementing includes: a first polarity control signal POL1, a second polarity control signal POL2, a first channel selection module C1, a second channel selection module C2, a third channel selection module C3, a fourth channel selection module C4, a first voltage selection channel L, a second voltage selection channel L', a first output port OUT1, a second output port OUT2, a third output port OUT3, and a fourth output port OUT4.

The first polarity control signal POL1 is used to control the first channel selection module C1 and the third channel selection module C3, and the second polarity control signal POL2 is used to control the second channel selection module C2 and the fourth channel selection module C4. The first voltage selection channel L includes a positive-polarity-voltage selection channel L1 and a negative-polarity-voltage selection channel L2, and the second voltage selection channel L' includes a positive-polarity-voltage selection channel L3 and a negative-polarity-voltage selection channel L4. The first channel selection module C1 includes a first input port in1 and a third input port in3, and the second channel selection module C2 includes a second input port in2 and a fourth input port in4. The third channel selection module C3 includes a first output port OUT1 and a third output port OUT3, and the fourth channel selection module C4 includes a second output port OUT2 and a fourth output port OUT4. The first and third input ports in1 and in3 of the first channel selection module C1 respectively receive a first grayscale signal and a third grayscale signal, and the second and fourth input ports in2 and in4 of the second channel selection module C2 respectively receive a second grayscale signal and a fourth grayscale signal.

In the embodiment of the present invention, the positive-polarity-voltage selection channel L1 of the first voltage selection channel L is called as an itself channel of the first grayscale signal, and the negative-polarity-voltage selection channel L2 of the first voltage selection channel L is called as a switching channel of the first grayscale signal; the negative-polarity-voltage selection channel L2 of the first voltage selection channel L is called as an itself channel of the third grayscale signal, and the positive-polarity-voltage selection channel L1 of the first voltage selection channel L is called as a switching channel of the third grayscale signal; the positive-polarity-voltage selection channel L3 of the second voltage selection channel L' is called as an itself channel of the second grayscale signal; the negative-polarity-voltage selection channel L4 of the second voltage selection channel L' is called as a switching channel of the second grayscale signal; and the negative-polarity-voltage selection channel L4 of the second voltage selection channel L' is called as an itself channel of the fourth grayscale signal, and the positive-polarity-voltage selection channel L3 of the second voltage selection channel L' is called as a switching channel of the fourth grayscale signal.

The first output port OUT1 is connected with the pixel electrode of the sub-pixels in the $(4n+1)^{th}$ column, and the polarity voltage corresponding to the first grayscale signal and output from the first output port OUT1 is the voltage of the pixel electrode of the sub-pixels in the $(4n+1)^{th}$ column. The second output port OUT2 is connected with the pixel electrode of the sub-pixels in the $(4n+2)^{th}$ column, and the polarity voltage corresponding to the second grayscale signal and output from the second output port OUT2 is the voltage of the pixel electrode of the sub-pixels in the $(4n+2)^{th}$ column. The third output port OUT3 is connected with the pixel electrode of the sub-pixels in the $(4n+3)^{th}$ column, and the polarity voltage corresponding to the third grayscale signal and output from the third output port OUT3 is the voltage of the pixel electrode of the sub-pixels in the $(4n+3)^{th}$ column. The fourth output port OUT4 is connected with the pixel electrode of the sub-pixels in the $(4n+4)^{th}$ column, and the polarity voltage corresponding to the fourth grayscale signal and output from the fourth output port OUT4 is the voltage of the pixel electrode of the sub-pixels in the $(4n+4)^{th}$ column.

When the first polarity control signal POL1 is at a high level, the first grayscale signal is input into the positive-polarity-voltage selection channel L1 via the first channel section module C1 and then provides a positive polarity voltage corresponding to the first grayscale signal to the first output port OUT1 via the third channel selection module C3; and the third grayscale signal is input into the negative polarity voltage section channel L2 via the first channel section module C1 and then provides a negative polarity voltage corresponding to the third grayscale signal to the third output port OUT3 via the third channel selection module C3, and at this time, the voltage of the pixel electrodes of the $(4n+1)^{th}$ column is the positive polarity voltage corresponding to the first grayscale signal, and the voltage of the pixel electrodes of the $(4n+3)^{th}$ column is the negative polarity voltage corresponding to the third grayscale signal.

When the first polarity control signal POL1 is at a low level, the first grayscale signal is input into the negative-polarity-voltage selection channel L2 via the first channel section module C1 and then provides a negative polarity voltage corresponding to the first grayscale signal to the first output port OUT1 via the third channel selection module C3; and the third grayscale signal is input into the positive polarity voltage section channel L1 via the first channel section module C1 and then provides a positive polarity voltage corresponding to the third grayscale signal to the third output port OUT3 via the third channel selection module C3, and at this time, the voltage of the pixel electrodes of the $(4n+1)^{th}$ column is the negative polarity voltage corresponding to the first grayscale signal, and the voltage of the pixel electrodes of the $(4n+3)^{th}$ column is the positive polarity voltage corresponding to the third grayscale signal.

When the second polarity control signal POL2 is at a high level, the second grayscale signal is input into the positive-polarity-voltage selection channel L3 via the second channel section module C2 and then provides a positive polarity voltage corresponding to the second grayscale signal to the second output port OUT2 via the fourth channel selection module C4; and the fourth grayscale signal is input into the negative polarity voltage section channel L4 via the second channel section module C2 and then provides a negative polarity voltage corresponding to the fourth grayscale signal to the fourth output port OUT4 via the fourth channel selection module C4, and at this time, the voltage of the pixel electrodes of the $(4n+2)^{th}$ column is the positive polarity voltage corresponding to the second grayscale signal, and the voltage of the pixel electrodes of the $(4n+4)^{th}$ column is the negative polarity voltage corresponding to the fourth grayscale signal.

When the second polarity control signal POL2 is at a low level, the second grayscale signal is input into the negative-polarity-voltage selection channel L4 via the second channel section module C2 and then provides a negative polarity voltage corresponding to the second grayscale signal to the second output port OUT2 via the fourth channel selection module C4; and the fourth grayscale signal is input into the positive polarity voltage section channel L3 via the second channel section module C2 and then provides a positive polarity voltage corresponding to the fourth grayscale signal to the fourth output port OUT4 via the fourth channel selection module C4, and at this time, the voltage of the pixel electrodes of the $(4n+2)^{th}$ column is the negative polarity voltage corresponding to the second grayscale signal, and the voltage of the pixel electrodes of the $(4n+4)^{th}$ column is the positive polarity voltage corresponding to the fourth grayscale signal.

Corresponding to the method mentioned above, an exemplary embodiment of the present invention provides a polarity inversion driving apparatus for a liquid crystal display panel, comprising:

a polarity control signal generating unit for generating N polarity control signals of different timings, wherein N is an integer and N≥2, and each polarity control signal is used to control a polarity voltage for sub-pixels in one or more columns of a liquid crystal display panel; and a polarity control signal outputting unit for outputting the N polarity control signals to polarity control lines in the liquid crystal display panel, wherein each polarity control line corresponds to one polarity control signal.

Another exemplary embodiment of the present invention provides a liquid crystal display, comprising the above polarity inversion driving apparatus for a liquid crystal display panel.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A polarity inversion driving apparatus for a liquid crystal display panel, comprising:

a polarity control signal generating unit for generating N polarity control signals of different timings, wherein N is an integer and N≥2, and each polarity control signal is used to control a polarity voltage for sub-pixels in one or more columns of the liquid crystal display panel;

a polarity control signal outputting unit for outputting the N polarity control signals to polarity control lines in the liquid crystal display panel, wherein each polarity control line corresponds to one polarity control signal;

first to fourth input ports for inputting first to fourth grayscale signals respectively;

first to fourth output ports for outputting respectively polarity voltages for the sub-pixels in corresponding columns;

a first voltage selection channel having a first positive-polarity-voltage selection channel and a first negative-polarity-voltage selection channel;

a second voltage selection channel having a second positive-polarity-voltage selection channel and a second negative-polarity-voltage selection channel;

first to fourth channel selection module, wherein the first and second grayscale signals, based on the voltage polarities thereof selected by the first channel selection module, are respectively input into selected polarity-voltage selection channels of the first voltage selection channel, and then are output to first and second output ports respectively via the third channel selection module, and wherein the third and fourth grayscale signals, based on the voltage polarities thereof selected by the second channel selection module, are respectively input into selected polarity-voltage selection channels of the second voltage selection channel, and then are output to the third and fourth output ports respectively via the fourth channel selection module;

a first polarity control signal input port, for receiving a first polarity control signal from the polarity control signal generating unit, to control the first and third channel selection modules; and a second polarity control signal input port, for receiving a second polarity control signal whose timing is different from that of the first polarity control signal from the polarity control signal generating unit, to control the second and fourth channel selection modules, wherein first to fourth sub-pixel columns respectively receiving the polarity voltages corresponding to the first to fourth grayscale signals are arranged to be sequentially adjacent to each other.

2. A liquid crystal display, comprising the polarity inversion driving apparatus for a liquid crystal display panel according to claim 1.

3. The liquid crystal display according to claim 2, wherein the N polarity control signals of different timings comprise a first polarity control signal and a second polarity control signal; and polarity inversion positions of the sub-pixels, whose polarity voltage is controlled by the first polarity control signal, of one or more columns of the liquid crystal display panel are different from those of the sub-pixels, whose polarity voltage is controlled by the second polarity control signal and which are adjacent to the sub-pixels controlled by the first polarity control signal, of other one or more columns of the liquid crystal display panel.

4. A polarity inversion driving apparatus for a liquid crystal display panel, comprising:

a polarity control signal generating unit for generating N polarity control signals of different timings, wherein N is an integer and N≥2, and each polarity control signal is used to control a polarity voltage for sub-pixels in one or more columns of the liquid crystal display panel;

a polarity control signal outputting unit for outputting the N polarity control signals to polarity control lines in the liquid crystal display panel, wherein each polarity control line corresponds to one polarity control signal;

first to fourth input ports for inputting first to fourth grayscale signals respectively;

first to fourth output ports for outputting respectively polarity voltages for the sub-pixels in corresponding columns;

a first voltage selection channel having a first positive-polarity-voltage selection channel and a first negative-polarity-voltage selection channel;

a second voltage selection channel having a second positive-polarity-voltage selection channel and a second negative-polarity-voltage selection channel;

first to fourth channel selection modules, wherein the first and third grayscale signals, based on the voltage polarities thereof selected by the first channel selection module, are respectively input into selected polarity-voltage selection channels of the first voltage selection channel, and then are output to first and second output ports respectively via the third channel selection module, and wherein the second and fourth grayscale signals, based on the voltage polarities thereof selected by the second channel selection module, are respectively input into selected polarity-voltage selection channels of the second voltage selection channel, and then are output to the second and fourth output ports respectively via the fourth channel selection module;

a first polarity control signal input port, for receiving a first polarity control signal from the polarity control signal generating unit, to control the first and third channel selection modules;

a second polarity control signal input port, for receiving a second polarity control signal whose timing is different from that of the first polarity control signal from the polarity control signal generating unit, to control the second and fourth channel selection modules, wherein first to fourth sub-pixel columns respectively receiving the polarity voltages corresponding to the first to fourth grayscale signals are arranged to be sequentially adjacent to each other.

5. A liquid crystal display, comprising the polarity inversion driving apparatus for a liquid crystal display panel according to claim 4.

6. The liquid crystal display according to claim 5, wherein the N polarity control signals of different timings comprise a first polarity control signal and a second polarity control signal; and polarity inversion positions of the sub-pixels, whose polarity voltage is controlled by the first polarity control signal, of one or more columns of the liquid crystal display panel are different from those of the sub-pixels, whose polarity voltage is controlled by the second polarity control signal and which are adjacent to the sub-pixels controlled by the first polarity control signal, of other one or more columns of the liquid crystal display panel.

* * * * *